United States Patent [19]

Ayler et al.

[11] Patent Number: 4,595,239

[45] Date of Patent: Jun. 17, 1986

[54] OIL RECOVERY MINING APPARATUS

[75] Inventors: Maynard F. Ayler, Golden; George Vranesh, Boulder, both of Colo.

[73] Assignee: Oil Mining Corporation, Golden, Colo.

[21] Appl. No.: 592,409

[22] Filed: Mar. 23, 1984

Related U.S. Application Data

[62] Division of Ser. No. 307,650, Oct. 1, 1981, Pat. No. 4,458,945.

[51] Int. Cl.[4] ..... E21B 33/03; E21B 33/13

[52] U.S. Cl. ..... 299/2; 166/95; 166/97

[58] Field of Search ..... 299/2; 166/75 R, 97, 166/95, 96, 77; 251/1 A, 1 R, 1 B

[56] References Cited

U.S. PATENT DOCUMENTS

| | | | |
|---|---|---|---|
| 1,722,679 | 7/1929 | Ranney | 299/2 |
| 1,852,717 | 4/1932 | Grinnell et al. | 166/82 |
| 1,884,858 | 10/1932 | Ranney | 299/2 X |
| 1,884,859 | 10/1932 | Ranney | 166/50 X |
| 1,910,762 | 5/1933 | Grinnell et al. | 166/82 |
| 2,148,327 | 2/1939 | Smith et al. | 166/84 |
| 3,207,221 | 9/1965 | Cochran et al. | 251/1 B |
| 3,227,229 | 1/1966 | Wakefield, Jr. | 166/75 |
| 3,613,806 | 10/1971 | Malott | 166/75 |
| 3,884,261 | 5/1975 | Clynch | 166/319 X |
| 4,046,191 | 9/1977 | Neath | 166/75 R X |
| 4,106,562 | 8/1978 | Barnes et al. | 166/227 X |
| 4,224,988 | 9/1980 | Gibson et al. | 166/75 R X |

*Primary Examiner*—Stephen J. Novosad
*Assistant Examiner*—Michael A. Goodwin
*Attorney, Agent, or Firm*—Charles W. Helzer

[57] ABSTRACT

New and improved techniques, systems and equipment for the practical underground mining of petroleum from both virgin and depleted oil fields under certain geological conditions, are described. A method of drilling relatively small diameter, drainage-type oil wells using a fluid and cutting control assembly from within an access underground drilled tunnel, is provided. The fluid and cutting control assembly facilitates the safe underground drilling and installation of the small diameter, drainage-type oil wells which can be operated either under the natural pressures occurring in the geological strata, as gravity drain wells or by suitable secondary treatment measures artificially pressurized to faciliate drainage of oil from oil bearing strata into which such wells are drilled. Techniques and equipment to facilitate the safe drilling of such wells, placing them into production and thereafter controlling operation of the mine workings in a safe and reliable manner, is described, together with the control system, sensors and other equipment required for safe installation and operation of an underground petroleum mine.

5 Claims, 10 Drawing Figures

FIG. 2
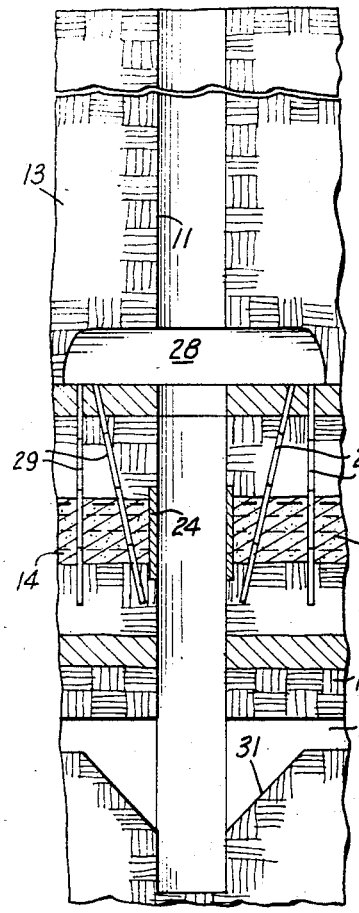
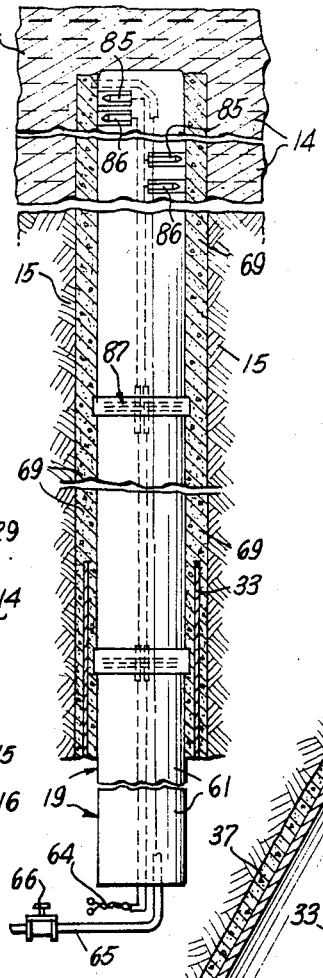
FIG. 9
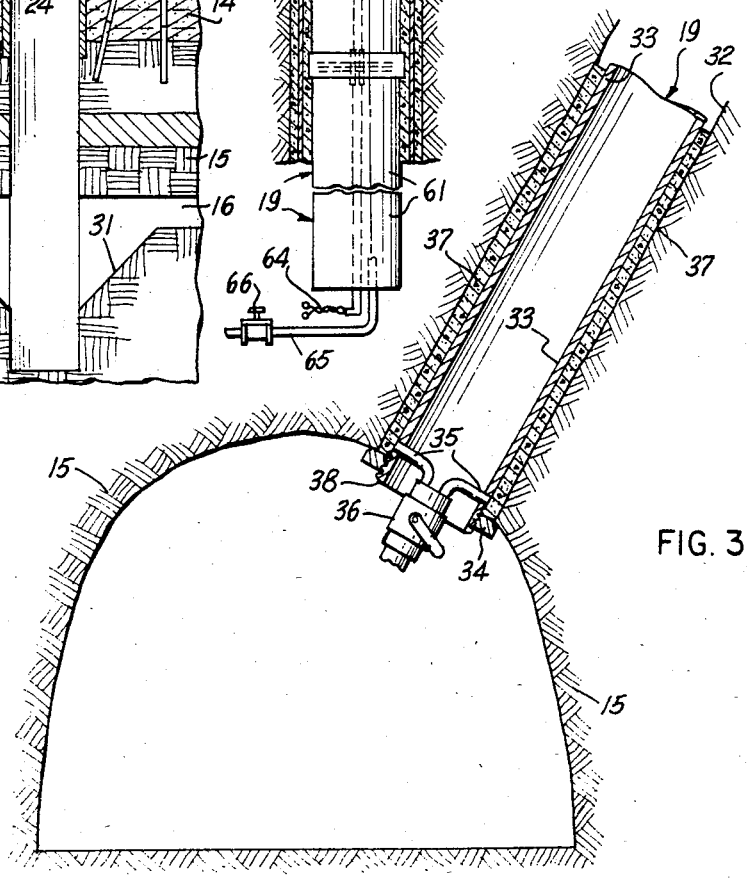
FIG. 3

OIL RECOVERY MINING APPARATUS

This is a division, of application Ser. No. 307,650, filed Oct. 1, 1981 now U.S. Pat. No. 4,458,945.

TECHNICAL FIELD

This invention relates to the recovery of oil using mining techniques and apparatus and is a Divisional Application of U.S. Pat. No. 4,458,945 issued July 10, 1984 for "Oil Recovery Mining Method and Apparatus" the disclosure of which is hereby incorporated into this application in its entirety.

More specifically, the invention relates to a novel apparatus for the recovery of oil contained in oil bearing fields which are either virgin (untapped previously by known oil well drilling and pumping techniques), currently producing fields, or are classified as depleted and incapable of further oil production using existing surface oil well drilling, pumping and secondary treatment techniques. The recovery of oil from such fields is achieved by the application of novel underground mining methods and apparatus used in combination with oil well technology.

BACKGROUND PROBLEM AND PRIOR ART

The petroleum industry began in 1859 in Pennsylvania when the Drake well was drilled purposely to find liquid petroleum. The petroleum industry grew very slowly. It was not until 1901, with the discovery of the Spindletop field in Texas, that the world was convinced there was more petroleum than could ever be consumed. The birth of the automobile industry created a growing demand for petroleum products and an accelerated growth in the petroleum industry.

As the world had more petroleum than it could consume, the oil reservoirs found prior to 1940 were produced utilizing only the natural energies of the petroleum accumulation. In the late 30's waterflooding and gas injection were initiated in some petroleum reservoirs that had been depleted of their natural energies. These reservoirs were usually at pressures of less than 100 psi and were waterflooded at pressures of 400 to 800 psi.

After World War II the petroleum industry began utilizing more engineering in the development of petroleum reservoirs. This resulted in initiation of pressure maintenance by water injection and gas injection much earlier in the productive life of the reservoir. These injection projects were carried out at pressures usually in excess of 500 psi and often at pressures as high as 4000 psi. Oil remaining in these reservoirs contains considerable gas in solution.

In the late '50's it was already evident that finding new petroleum was becoming more difficult and more expensive. The world demand for petroleum had grown at an unpredicted rate. It became evident that the world would soon be short of petroleum. As a result, new processes were initiated in an attempt to recover more of the petroleum that had already been found. These new processes, fire-flooding, steam stimulation, steam flooding and misciable flooding, were initiated in an effort to increase the recovery from existing reservoirs. Most of these techniques were very expensive and in most cases did not achieve the desired degree of success. At present, the only process still being utilized is steam stimulation and steam flooding, in reservoirs with low gravity and viscosity oil.

In the mid '60's the industry began to investigate possibilities of tertiary recovery in reservoirs that had been water flooded in the mid '40's. Tertiary projects utilizing caustics, surfactants, special emulsions and polymers were initiated on an experimental basis. At the present time the Federal government, through ERDA, and the petroleum industry are continuing to investigate the tertiary recovery processes. None of these techniques have been classified an economic success with a great future potential of recovering large quantities of additional petroleum.

In the late 1960's the first large scale commercial mining of an oil sand was initiated in Alberta, Canada. This project is strip mining a "tar" sand and processing the sand to recover the hydrocarbon. The project was uneconomic at world oil prices prior to 1973. The project became economical after petroleum prices were increased. As of this writing other projects scheduled in the area have still not been placed on a production status because of economics.

Oil reservoirs which may be candidates for a mining recovery process can be classified into two general categories, depleted or virgin. The depleted reservoirs were estimated to contain some 300 billion barrels of unrecovered oil in a 1976 study by the National Petroleum Council and are estimated to comprise between 60 and 80 percent of the oil originally present in these fields. The depleted reservoirs can be classified into two general categories; those which have undergone some type of secondary recovery process and those which have only been primarily depleted. The former category would probably be classified as containing the greatest amount of remaining petroleum because they represent the greatest number of petroleum reservoirs. A considerable number of primary depleted reservoirs exist in the viscous crude oil category. Some of these reservoirs have undergone steam stimulation but not a secondary recovery process. The volume of oil in this category is probably in excess of 150 billion barrels.

The depleted systems which have undergone secondary recovery processes are the ones flooded in the late '30's and early '40's. These were at relatively shallow depths and which were at very low pressures. Some of these reservoirs were placed on a vacuum during World War II and hence would contain very small amounts of gas in solution in the oil. The low gas in solution results in very small amounts of any gas in the reservoir to be utilized as a displacing fluid.

The other type of reservoirs which have undergone secondary recovery will have been flooded at pressures in excess of 50 psi and will have considerable gas in solution and possibly free gas to assist in the removal of fluids from the formation.

These depleted reservoirs will probably contain oil having the following properties.

Viscosity—1 to 10 centiposes

Gravity—greater than 25° API

Gas in Solution—between 10 and 800 std. cu. ft. per reservoir barrel

Oil Saturation—between 10 and 40 percent of the pore space

Porosity—between 15 and 30 percent

Whether these reservoirs will be feasible for a mining process will be a function of the product of the formation thickness, formation porosity and residual oil saturation.

Oil in Place = Area × Thickness × Porosity × Oil Saturation. Factors of depth and mineability of formations above or below the oil zone itself will be major factors in the economics or feasibility of any such process.

The reservoirs which have undergone primary depletion only, with or without steam stimulation, will normally contain a much higher percentage of inplace oil at the time any mining process may be initiated.

These reservoirs will normally contain a more viscous oil, be at relative low pressures, and at relatively shallow depths. These reservoirs are represented by the higher viscosity oil reservoirs in California, Venezuela, and in Canada. They are presently being produced but with great difficulty. There is probably over 500 billion barrels of oil in this class of reservoir in the world.

Virgin reservoirs which might be susceptible to underground mining are represented by the known tar sands and the very viscous or high pour point oil deposits throughout the world. It is known that very extensive reserves of petroleum exist in these type of deposits in the United States, Canada and South America. The estimated reserve is 1,000 billion barrels. These virgin deposits are susceptible to both strip mining and to some types of underground recovery.

The "tar" sands which are being produced in Canada by means of strip mining have been drilled and tested by conventional petroleum recovery mechanisms with very little success. The petroleum content of these "tar" sands change into a very viscous oil with depth. They have not been treated with combinations of known recovery technology in order to make them productive. They have been overlooked as a potential source of petroleum production primarily because of the quality of the petroleum and their location. In many cases these reservoirs represent a petroleum deposit which is directly mineable by surface methods. As the depth of these deposits increase, the contained petroleum is very highly viscous and has gas in solution so that removal of the petroleum containing formation is not possible because of gas release to the atmosphere in the pit and the resultant ventilation and fire-explosion hazard.

It is believed that using available mining technology it is possible to develop mine working preferably beneath the oil-water contact of certain oil fields in selected areas. By being below the oil-water contact, it should be possible to hold the greatest hazard to mining, the inflow of any of the gasses normally associated with oil production, to an acceptable minimum.

The concept of applying mining techniques to the production of oil from oil bearing sands, both virgin and depleted, is both old and well known as described in a United States Bureau of Mines Bulletin No. 351 entitled "Mining Petroleum by Underground Methods" by George S. Rice published by the U.S. Government Printing Office in Washington, D.C. in 1932. Methods for the underground mining of oil were further investigated and reported in a bulletin entitled "Mining For Petroleum: Feasibility Study" prepared for the U.S. Department of the Interior-Bureau of Mines under contract No. J0275002 July, 1978. These prior art publications while informative, do not include sufficient specific details of how to go about overcoming the many practical problems encountered in the underground mining of petroleum. To overcome this deficiency the present invention was devised.

SUMMARY OF INVENTION

It is therefore a primary object of the invention to provide new and improved techniques and equipment for the practical underground mining of petroleum from both virgin and depleted oil fields under certain geological conditions where such mining of oil is feasible.

In practicing the invention, drilling relatively small diameter drainage-type mine oil wells using a novel fluid and cutting control assembly, is provided. The fluid and cutting control assembly comprises a stop valve mounted on a pipe casement for securement to a firmly anchored collar pipe providing the outer liner for an access opening to a drainage-type mine oil well. The drainage-type mine oil well is drilled into the overlying roof of a tunnel cut into a competent rock zone below oil well sands containing unrecovered oil. The gate valve and pipe casement have an inside diameter opening with the gate valve in the open condition which is sufficient to accommodate the outside diameter of a drainage-type mine oil well production conductor pipe and/or a drill bit and drill string together with appended stop valve, coupling and the like required to support the drill string or production conductor pipe. Upper and lower blow-out preventers are secured to the casement below the stop valve and have internal diameters sufficient to accommodate the external diameter of the drainage-type mine oil well production conductor pipe and/or the drill string fitting for the drill bit. An upper drain vent control valve is connected to a first drain vent branch pipeline and to the casement between the stop valve and the upper blow-out preventer. A lower drain vent control valve is connected to a second drain vent branch pipeline and to the casement intermediate to the upper and lower blow-out preventers. With the fluid and cutting control assembly in place mounted on the annular collar, a drill bit and supporting drill string is inserted through the opened lower and upper blow-out preventers and through the opened stop valve. The small diameter gravity-type oil drain well is then drilled upwardly through the overlying competent rock roof of the tunnel and into the oil bearing sand zone to a desired depth while supplying cutting fluid to the drill bit under pressure upwardly through the drill string. During drilling, the upper and lower blow-out preventers are maintained tightened down on the exterior of the drill string to only a slide fit and cutting fluid and entrained cuttings are drawn off through the upper and lower drain vent control valve and the connected branch drain pipeline for supply through a piping system installed in the tunnel and to a pump for pumping to the surface and disposal.

Another feature of the invention is the provision of oil well production conductor pipe in the relatively small diameter drainage-type mined oil wells after drilling in the above-described manner. Apparatus for installing the pipe includes upper and lower blow-out preventers for use while withdrawing the drill string to the point where the drill bit is just below the stop valve while drawing off any fluid cutting oil and gas and water entrained in the fluid through the upper and lower drain vent control valve for removal to the surface in the above-described manner. The stop valve is then closed and the drill bit completely withdrawn from the fluid and cutting control assembly. A production conductor pipe is then inserted within the casement through the loosened upper and lower blow-out preventers to a point where the upper end of the conductor pipe is just below the stop valve. The blow-out preventers are then tightened to the point of providing only a slide fit for the exterior surface of the production conductor pipe while maintaining the upper and lower drain vent control valve open and under suction to drain off any leakage of fluid past the upper blow-out preventers. The stop valve is then opened and the production conductor pipe driven upwardly through the drilled opening into the oil bearing sand strata to a desired depth.

Another feature of the invention is the provision of a closure over the upper end of the relatively small diameter drainage-type oil mine well production conductor pipe during the emplacement thereof in the preceeding described manner together with selectively opening the upper end of the production conductor pipe after it is secured in place to a desired depth into the oil sand strata in order to place the well into production. To facilitate placement of the production conductor pipe with its upper end closed, the pipe is vented during emplacement and subsequent cementing into place. For this purpose, it is necessary to vent the space intermediate the drilled hole and the conductor pipe as it is being emplaced and cemented. To accomplish the venting, a small diameter flexible fluid impervious venting tube is supported through the interior of the conductor pipe while it is being emplaced and at the upper tip end thereof extends through a small port in the upper end of the conductor pipe. A control valve is secured in the venting tube at a lower accessible end of the tube so that it can be controllably opened and closed to control the venting through the tube. The discharge end of the vent tube is led through the tunnel back up through the access shaft to the surface in order that the mine atmosphere is not contaminated with gases vented through the venting tube.

Still another feature of the invention is the provision of means for permanently cementing the production conductor pipe into place by first tightening down the upper and lower blow-out preventers to the greatest possible extend to prevent movement of the conductor pipe during cementing. Cement under pressure is then forced from a cement pump connected through the upper drain vent control valve and its interconnected first branch pipeline to the space surrounding the conductor pipe. During cementing the stop valve is in its fully opened condition so that it is not cemented into place and subsequently can be removed along with the fluid and cutting control assembly. To facilitate this operation, the space between the upper and lower blow-out preventers preferably is flooded with water during the cementing stage. After setting of the cement, the fluid and control assembly casement including the stop valve is removed and a new stop valve coupled to the end of the cemented in place production conductor pipe along with any additional lengths of production conductor pipe required to lead away the oil produced by the well to a suitable collection point within the mine tunnel system.

A still further feature of the invention is the provision of means for opening the upper end of the production conductor pipe after it has been cemented into place. A preferred method is to attach a small charge of explosive to the closed upper end of the production conductor pipe and thereafter selectively detonating the charge to blow open the top of the conductor pipe and place it into production. An alternative method is to employ a Johnson Screen together with a suitable closure element such as a one way check valve disposed in the conductor pipe below the screen. A small charge of explosive should be attached to the closure element and a small remotely operated detonator secured to the charge for selectively detonating the charge and blowing open the closure element to place the oil well into production through the Johnson screen. In the case of the Johnson Screen care must be exercised to assure that the cement is not allowed to rise sufficiently high to close the Johnson screen. A further method is to employ a Schlumberger type perforating gun secured to the interior of the closed end of the production conductor pipe while it is inserted into place and thereafter remotely fired to perforate the upper end and upper sides of the production pipe in order to place the well into production.

BRIEF DESCRIPTION OF DRAWINGS

Other objects, features and many of the attendant advantages of this invention will become better understood upon a reading of the following detailed description when considered in connection with the accompanying drawings; wherein, like parts in each of the several figures are identified by the same reference character, and wherein:

FIG. 2 is a schematic drawing illustrating a preferred way of driving an enlarged diameter shaft of sufficient size to accommodate men and equipment through a competent rock zone to near the oil and gas bearing horizon, then providing an annular chamber by means of which small drift holes are drilled in an annular array around the intended path of the extended large diameter access shaft to permit freezing, grouting or otherwise stabilizing the oil-producing zone to permit sinking of the large diameter access shaft through it to a second lower competent rock zone into which access tunnels beneath the oil field can be drilled. FIG. 2 also illustrates the provision of a fluid impervious casing around the large diameter access shaft for the portion of the length thereof which extends through the oil bearing sand strata;

FIG. 3 is a schematic illustration of the manner in which a relatively small diameter drainage-type mine oil well is initially drilled through the roof of a tunnel formed in the underlying lower or second competent rock zone by initially placing a cemented in place enlarged diameter collar pipe in a larger diameter hole drilled upwardly through the roof of the tunnel so as to provide a solid anchor for a well hole collar pipe;

FIG. 9 illustrates still another alternative arrangement for perforating a production conductor pipe which has been sealed closed during its installation and emplaced within the oil bearing sand strata using a Schlumberger gun.

DETAILED DESCRIPTION OF BEST MODE FOR CARRYING OUT THE INVENTION

Figure 1:
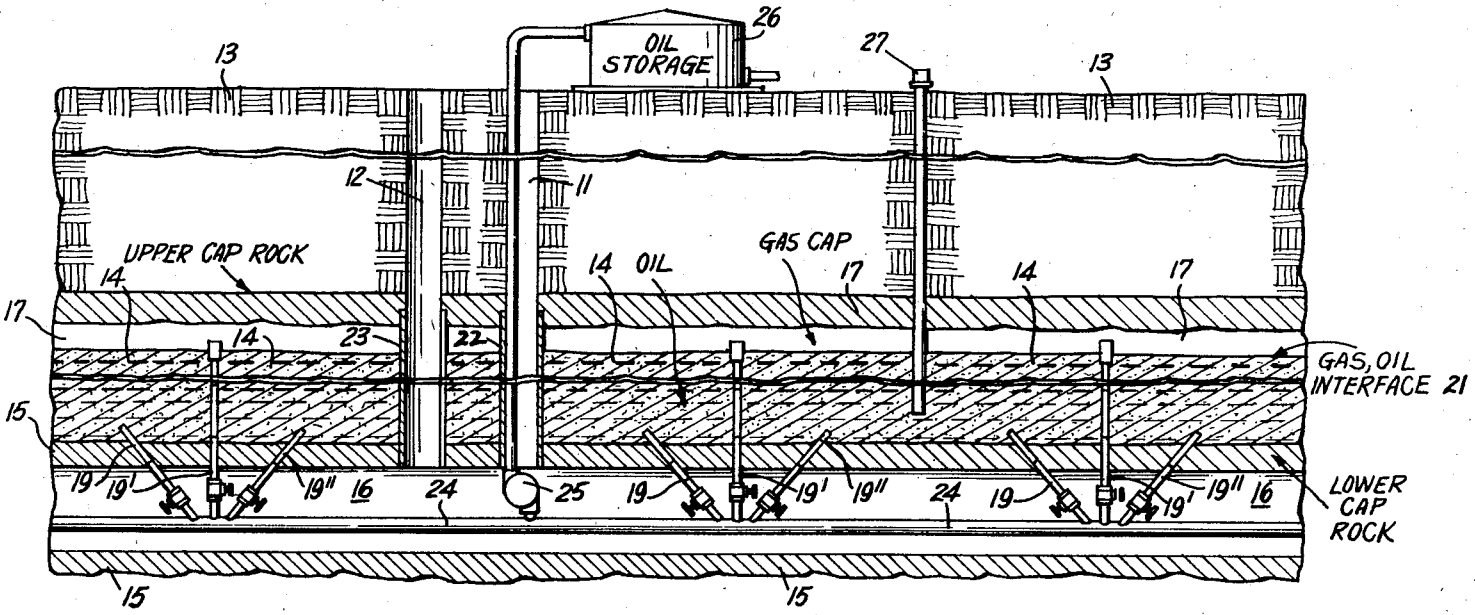
FIG. 1 is a detailed schematic drawing of an oil field being mined according to the invention which has a gas cap and illustrates the manner in which drainage-type production oil wells are connected to collection lines leading to a vertical access shaft where the oil is pumped to the surface for storage.

FIG. 1 illustrates an installation comprised by fluid impervious liners 22 and 23, respectively, for the vertical access shafts 11 and 12 which extend through an oil and gas bearing zone 14. FIG. 1 further illustrates a collection piping system 24 laid through a horizontal tunnel 16 which interconnects production conductor pipes 19, 19' and 19" at a plurality of drainage-type mine oil well sites to a pump 25 at the base of vertical acess shaft 11 which pumps the collected oil and gas to an oil storage tank 26 on the surface. The installation shown in FIG. 1 includes a gas cap 17 and an oil-gas interface shown at 21. For this reason, the lengths of some of the small diameter gravity-type drain oil well pipes 19' are extended above the oil-gas interface. It is possible that there may have been existing surface oil wells such as the one indicated at 27 driven into the field which are no longer sufficiently productive to justify further working. In such instances the abandoned surface oil wells could be capped as indicated or alternatively could be used as a means for introducing secondary treatment agents such as hot steam, compressed gas, water, etc., to increase working pressure within the oil sand strata. In addition to such measures, one or more of the individual gravity-type oil production conductor pipes 19 at different locations along the length of the access tunnel could be disconnected from the main collection pipe 24 and instead connected to a secondary treatment agent supply pipe 23 such as shown in FIG. 7A of the drawings in order to introduce such secondary treatment agents into the oil bearing sand strata at different selected sites along the length of the access tunnels.

FIG. 1 illustrates a geological installation wherein there is a gas cap 17 interposed between the uppr cap rock 13 and the oil bearing sand strata 14. In such installations it may be desireable to provide drain oil well production conductor pipes such as 19' of sufficient length to reach into the gap cap 17 for the purpose of controlling pressure induced by the existence of the cap. For this purpose, the extended lengths of production conductor pipes such as 19' could be used to bleed off certain of the gas pressure in the gas cap to maintain it below certain predetermined levels or alternatively, such extended lengths of pipe could be connected to pressurized gas sources for increasing the pressure within the gas cap for improving production from the other adjacent drainage-type oil mine production conductor pipes such as 19 and 19" or those located further along tunnel 16.

The existence of a gas cap such as shown at 17 in FIG. 1 would tend to complicate the process of driving a large diameter access shaft such as 11 or 12 down through the upper cap rock 13 into and through the oil bearing sand strata and thence down into the lower cap rock 15. The gas cap zone would be relatively free of water or oil and thus would probably not respond to freezing techniques and may not react satisfactorily to grout. If such conditions are indicated by prior exploration and evaluation, it is likely that rotary drilling of the shaft, using conventional oil well drilling needs and techniques, would be indicated. Shaft casing can be floated on the mud, down into position, and cemented, perhaps using the same technique as was used in lining the U.S. Bureau of Mines deep shaft through oil shale near Rio Blanco, Colorado.

Where gas cap danger is not indicated but it will be necessary to sink the shaft through and oil and/or water saturated formation, the shaft can be sunk by any conventional sinking procedure to a safe depth above the oil-bearing zone 14 as shown in FIG. 2. At this particular level, an annular chamber shown at 28 is mined in the upper competent cap rock 13 so as to completely surround the shaft location 11. From the floor of the annular chamber 28, a number of very small diameter drill holes are drilled completely around the circumference of the path of the projected vertical access shaft 11 as shown at 29. The vertical drill holes 29 are then supplied with a suitable solidifying agent such as grout, cement, silicon fluoride or the like or alternatively may be supplied with a suitable refrigerant for freezing the oil sands 14 within the region of the projected path of the vertical access shaft. The vertical access shaft is then drilled through the solidified gas and oil bearing sand region and sides of the shaft in this region are lined with a suitable fluid impervious liner 23 or 24 as described earlier with respect to FIGS. 2 and 2A of the drawings. The drill holes 29 must be positioned so that the temperature of the oil and gas zones 14 can be lowered below the freezing point of water and pour point temperature of the contained oil. As noted above, freezing may be replaced by the use of any of the several possible grouts including but not limited to AM-9 manufactured and sold by American Cyanamide, silicon fluoride or cement grouting. In the event that the oil and gas region 14 is quite shallow and close to the surface of the earth, the drill holes 29 could be drilled from the surface in a similar manner in order to solidify the projected path through which the vertical access shaft must be driven. After the oil and gas bearing zone 14 has been frozen or otherwise stabilized, the shaft 11 can be driven, using gassy mine techniques through the oil and gas bearing zone 14 down to and through a portion of the lower competent cap rock region 15. If desired, a suitable sump such as shown at 31 can be provided at the base of the vertical access shaft.

The development of the mine workings using vertical access shafts 11 and 12 drilled in the above briefly described manner, can be on whatever pattern appears appropriate as dictated by cost analysis of the geology of the particular oil deposit being mined. The mine workings are solely for the purpose of providing access for drill site locations for the relatively small diameter drainage-type oil wells to be drilled upwardly into the overlying competent cap rock roof of the access tunnel 16. The location of the drainage-type oil well sites along the lengths of the access tunnel will be determined primarily by the following basic factors:

(a) Competence and impermeability characteristics of the host rocks in which the access tunnel 16's have been bored.

(b) The location of needed drill sites as determined by the nature of the oil deposit.

(c) Ventilation requirements.

(d) Optimum scheduling permiting simultaneous continued mine development, drilling of production wells and completion and production from producing wells.

(e) Accomplishing the above with the least possible complexity of the mine workings.

Since each oil field is different from all others, the above analysis undoubtedly will result in different mine layouts for each field. As previously noted, the mine workings simply are to provide continuous access to the producing drain oil wells, a way of removing waste during mine development and any that may develop later and to provide passageways for the positioning of production pipelines for removal of produced oil and gas. The mine workings in the form of the access tunnels can be driven by known underground mining drilling-blasting-muck removal techniques and by the utilization of horizontal tunnel boring systems with or without hydraulic jet assist. Whatever system is used, it will be advantageous in the environment noted to keep fracture of the raw rock around the tunnels to a minimum in order to assist in prevention of undesired leakage from the overlying oil and gas horizon. Also it is anticipated that all of the small diameter drainage-type mine oil wells such as 19, 19' and 19" within the mine workings would be tied into central piping systems designed to optimize both manual and automatic production control of oil and gas through the well head.

Referring to FIG. 3 of the drawings, a cross section of one of the access tunnels 16 is illustrated with the cross section being taken through a drainage-type oil mine well site. At the well site, a hole shown at 32 is drilled upwardly through the overlying roof 15 of access tunnel 16 at any angle upward through only a portion of the competent rock cap surrounding access tunnel 16. The hole 32 is drilled to a depth great enough to permit solid cementing into place of a collar pipe 33. The collar pipe, for example, may have a diameter from about 6 to 8 inches more or less depending upon the desired diameter for the gravity-type drain oil wells to be installed at the site. A shoe flange shown at 34 is threaded over the lower threaded end 38 of collar pipe 33 in order to close the space between the outer surface of collar pipe 33 and the inside of the drilled hole 32. Cement is then supplied under pressure to this space via cement ports 35 formed in the end of the collar pipe above the threaded end 38 and a cement gun nozzle shown at 36. After cementing, the cement gun 36 is removed and the ports 35 closed with suitable stoppers while the cement 37 sets. After the cement 37 has set, so as to firmly seal collar pipe 33 into place in the drilled hole 32, the shoe flange 34 can be unscrewed and removed.

Figure 4:
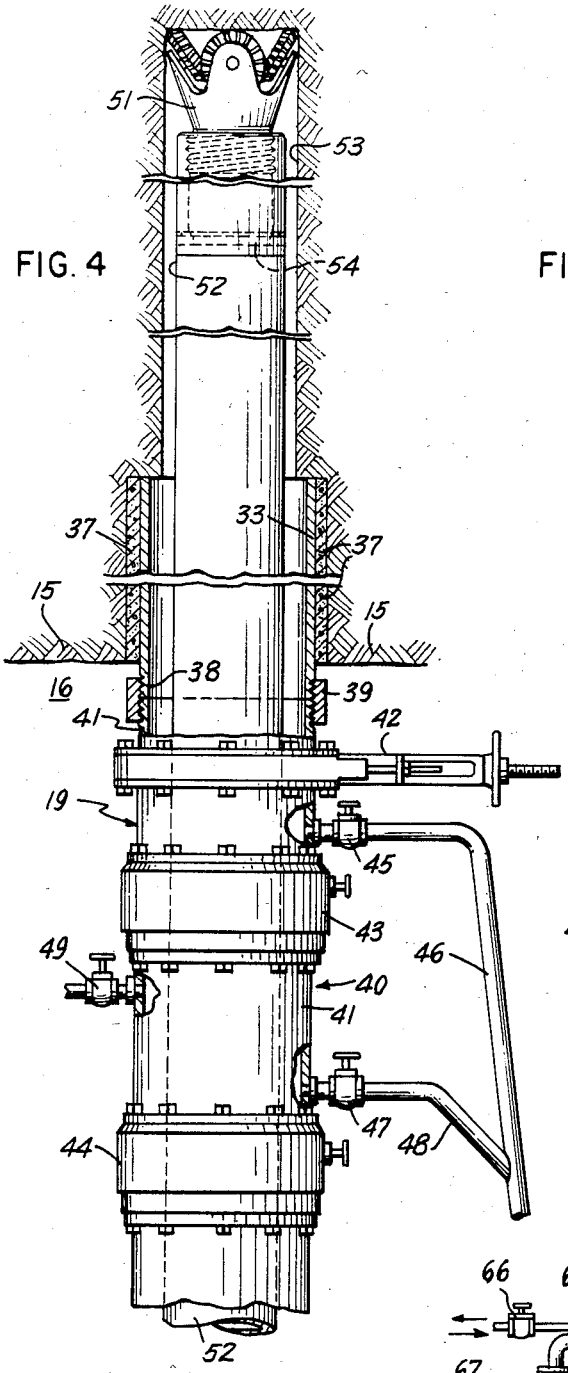
FIG. 4 is a schematic, side sectional view of a novel fluid and cutting control assembly according to the invention and shows the same installed in place on a drainage-type mine oil well being drilled in the roof of one of the access tunnels to permit the drilling of such wells within the mine without contaminating the mine workings atmosphere.

With reference now to FIG. 4 of the drawings, the cemented into place collar pipe 33 has a coupling 39 screwed onto its lower threaded end 38 for coupling to the collar pipe 33 a fluid cutting and control assembly shown generally at 40. The fluid cutting and control assembly 40 is comprised by an outer casement 41 which in fact may be made up of different segments which include a manually operated stop valve 42 which may be of the well known, commercially available gate valve type, an upper blow-out preventer 43, a lower blow-out preventer 44, an upper drain vent control valve 45 connected to the casement 41 intermediate stop valve 42 and the upper blow-out preventer 43 and a lower drain vent control valve 47 connected to casement 41 in the space between upper and lower blow-out preventers 43 and 44. The upper and lower drain vent control valves 45 and 47 are connected through respective branch pipelines 46 and 48 to a suitable trunk pipeline that carries fluids used during drilling, any entrained oil, gas, rubble and the like away through a suitable mud pump (not shown) for transport through a conduit laid down through the access tunnels and vertical access shaft up to the surface and discharged to a suitable collection point. Where it is desired to use the fluid and cutting control assembly 40 repeatedly at different well sites, a third drain vent control valve 49 is provided together with an interconnected branch pipeline for connection to the same discharge conduit system. The purpose of the third drain vent control valve 49 will be described more fully hereinafter with relation to FIG. 5 of the drawings.

The drain vent control valves 45, 47 and 49 are entirely conventional and available commercially, and hence need no further description. Likewise, the piping, collar pipe, casement segment, couplings, flanges and the like are believed to be entirely conventional and commercially available and require no further description. The stop valve 42 and upper and lower blow-out preventers 43 and 44 similarly are conventionally available items obtainable from oil field equipment supply firms such as the Hydril Co. of Los Angeles, Calif., the Gardner Denver Corp., the Grinnell Valve Co. and the Jamesbury Corp. These items must be of sufficient size so that their inside diameters will accommodate passage through the centers of the equipment and valves of the outside diameter of a drill bit 51 and its associated supporting drill string 52, couplings between segments of the drill string and a one-way flap or check valve 54 which is mounted at the top of the drill string 52 immediately under the drill bit 51. The flap valve which is set in the first section of the drill string or drill pipe 52 supporting drill bit 51 permits drilling fluid such as water under pressure to flow upward around the drill bit 51 to facilitate drilling but will check or stop any back pressure to the drill string 52 and prevents any backflow of such fluid down through the inside of drill pipe 52 when the drilling fluid input is discontinued.

With a drilling rig such as manufactured by Joy Manufacturing Company of Boyles Bros. set up in the manner shown in FIG. 4, the drill bit and its supporting string is inserted through the fluid and cutting control assembly 40 by loosening the blow-out preventers 43 and 44 and opening the stop valve 42 to allow passage of the drill bit 51 and its supporting string up through the casement 41 to the end of the hole in which the firmly anchored collar pipe 33 is cemented. The blow-out preventers 43 and 44 are then tightened down to just a slide fit, drilling fluid is supplied to the inside of the drill pipe 52 and the drain vent valves 45 and 47 opened to drain off the drilling fluids and any entrained solid matter contained in such drilling fluids. If desired, a suction can be placed on the drain conduit connected to the branch pipelines 46 and 48 via a suitable mud pump of the type sold by Ideco or Envirotech (not shown) connected to the conduit for pumping the fluids back up to the surface and discharged. During drilling in a conventional fashion, the check valve 54 will prevent any backflow of fluids, gas, or other matter due to encountering a high pressure pocket as drilling, proceeds. The drilled oil well drainage hole 53 then is drilled upwardly through the roof of the overlying competent rock shelf 15 out into the oil bearing sand strata as described previously with respect to FIG. 1 of the drawings.

Figure 5:
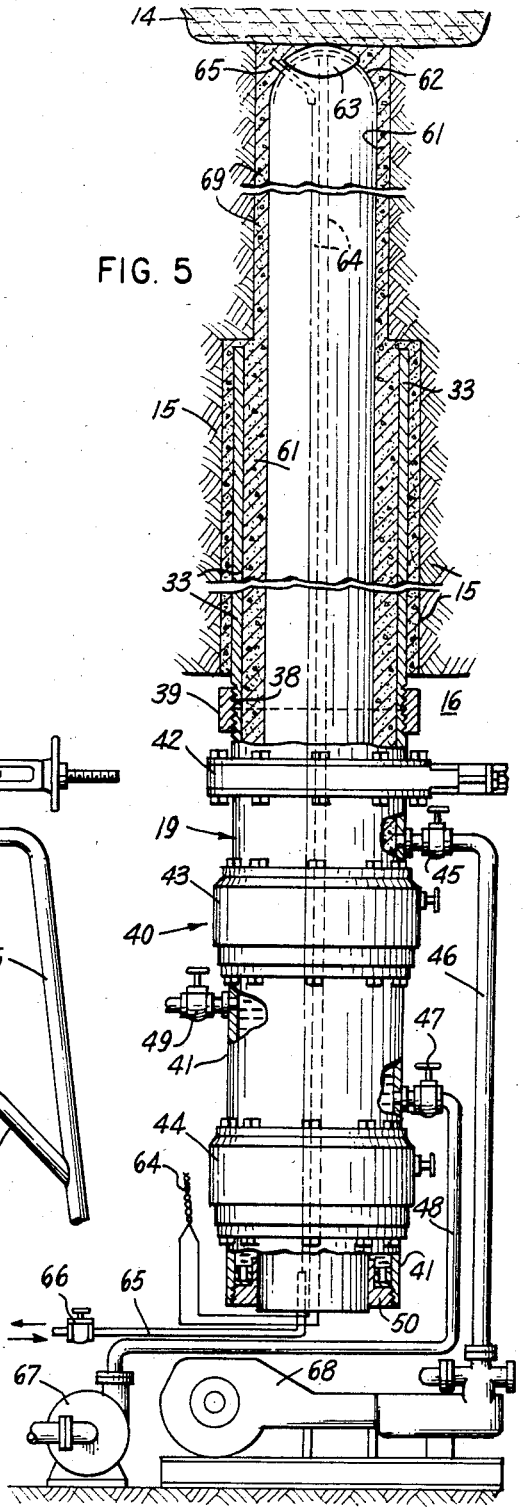
FIG. 5 is a schematic elongated side sectional view similar to FIG. 4 illustrating the manner in which a production conductor oil pipe for a drainage-type mine oil well is cemented into place employing the fluid cutting and control assembly.

After drilling of the oil well hole 53 at a particular site has been completed to a desired depth, the drill rig is then withdrawn from the hole. To facilitate this operation, as well as the drilling operation, it is anticipated that the drill string 52 will be coupled to drill bit 51 in segements which would allow its handling within the confines of access tunnel 16. For this purpose, the drill string is withdrawn until the drill bit 51 is just below the stop valve 42. At this point in the withdrawal of the drill string, the stop valve 42 is closed so as to hold off any back pressure that otherwise might force gas, oil, water, or other rubble down into the access tunnel 16. The drill string is then withdrawn completely by loosening the blow-out preventers 43 and 44 and from this point on further withdrawal of fluids through the drain vent valves 45 and 47 and their interconnected branch pipeline would cease. An oil production conductor pipe 61 shown in FIG. 5 of the drawings is then mounted for emplacement in the previously drilled oil well hole 53. The oil production conductor pipe 61 likewise will be inserted into the hole in suitable length segments so that it can be handled within the confines of the access tunnel 16. As best shown in FIG. 5, the topmost segment of the conductor pipe 61 has its end 62 completely closed so that after it is inserted in place in hole 53 and cemented as shown at 69 in a manner to be described more fully hereafter, it will prevent the passage of any oil, gas, water or other fluid down through the conductor pipe until it is desired to commence production from the oil well site.

In order to insert the oil production conductor pipe 61 into place, the blow-out preventers 43 and 44 are loosened and the topmost segment of the conductor pipe 61 inserted in the fluid and control assembly 40 to a point where the closed end 62 of the topmost segment of conductor pipe 61 is just below stop valve 42. At this point the blow-out preventers 43 and 44 are tightened down to just a slide fit so that the conductor pipe 61 can be lifted upwardly through hole 53 segment by segment until it reaches the desired depth into the oil bearing sand zone 14 as shown in FIG. 5. At this point, the blow-out preventers 43 and 44 are tighted down to a firm grip and water under pressure is supplied from a water pump 67, which may be somewhere in the tunnel system or possibly even on the surface through the branch pipe 48 and vent control valve 47 to the space intermediate conductor pipe 61 and casement 41. The space between the outside surface of the oil conductor pipe 61 and the inside of casement 41 is then flooded with water under pressure between upper and lower blow-out preventers 43 and 44. During this flooding, the air in the space is vented through the third vent and control valve 49 until water passes through the valve and then the valve is closed so that the space can be pressurized with water. As a backup, a retainer collar 50 may be threaded into the end of the casement 41 below the lower blow-out preventer 44 so as to completely seal off the possibility of water seeping past the lower blow-out preventer and down into the tunnel space 16. Alternatively, it may be desired to also flood this space by slackening the lower blow-out preventer 44 until the space is filled and pressurized to the same extent as the upper space and then retightening the lower blow-out preventer. By this means, cement will not be allowed to enter into the fluid and coupling assembly so that it can be removed and reused at different oil well sites in the tunnel.

With the production conductor pipe 61 in place and the fluid and control assembly 40 flooded in the above-described manner, a cement pump 68 is coupled through the branch pipeline 46 and drain vent control valve 45 to the space between the entire extent of the production conductor pipe 61 and the inside of the oil well hole 53 above the stopped down upper blow-out preventer 43. At this point the stop valve 42 is in the fully opened condition so that cement provided through the upper fluid vent control valve 45 is allowed to pass upwardly into the space. During cementing, gas or fluids in the space above the cement level as it rises in the space intermediate the sides of hole 53 and the exterior surfaces of conductor pipe 61 is vented if necessary through a suitable fluid impervious vent pipe shown at 65 which extends out of a port in the closed upper end of the upper production conductor pipe segment 61. This fluid impervious vent tube 65 exends down through the interior of the conductor pipe 61 along with suitable detonator wire 64 for detonating a charge of explosive 63 attached to the upper closed end 62 of conductor pipe 61. The vent tube 65 leads down through a vent tube control valve 66 which may be located remotely on the surface or at some other accessible point in the mine working system where it is safe to locate the valve and may be even right at the base of the oil well site being worked upon as shown in FIG. 5. As cementing takes place and cement rises upwardly around the production conductor pipe 61, venting of the space in this manner will facilitate the cementing process. After cementing has been completed, the upper drain vent control valve 45 may be closed down and the cement allowed to set so as to assure firm anchoring in place of the oil well production conductor pipe 61.

Figure 6:
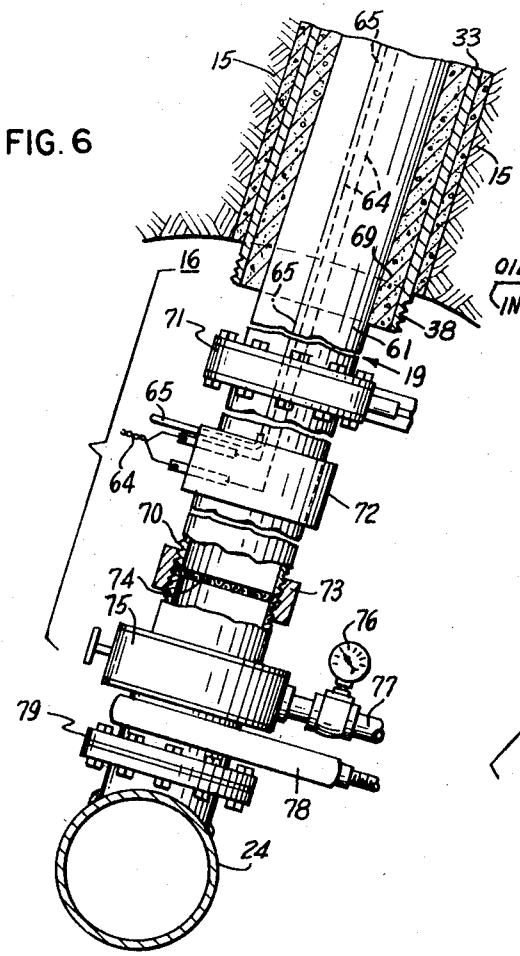
FIG. 6 is a partial elongated sectional view of a cemented-in-place production conductor pipe for a drainage-type mine oil wells after it has been processed according to FIGS. 4 and 5 and showing different types of stop valves, screens, detonator control circuits, flow control valves as well as other measuring instruments, and the connection of the cemented-in-place oil well conductor pipe to an oil collection piping system that runs through the mine tunnel for accumulating oil drained from a multiplicity of different drainage-type oil wells placed along the length of the tunnel.

FIG. 6 of the drawings shows the final production conductor oil piping installation after the cement 69 has set and firmly anchored the segments of the conductor pipes 61 extending through the tunnel 16 roof. After cement 69 has set, the water within the casement 41 between the upper and lower blow-out preventers 43 and 44 is drained out via the lower drain vent control valve 47 and pump 67 which may be a reversible pump or alternatively connected through a branch pipeline to a single acting pump used to reverse flow of water through the casement section and branch pipeline 48. Following this, the entire fluid and cutting control assembly 40 is removed including the interconnected branch pipelines 46 and 48 and the stop valve 42. Following this step, a new segment of conductor pipe indicated at 70 is coupled to the end of the cemented conductor pipe 61 protruding beyond the end of the cemented section 69 by means of a coupling (not shown) which may be of the type indicated at 73. In this additional segment of production conductor piping a stop valve 71 is provided which may be of the conventional gate valve type available from any oil field equipment manufacturer or supply warehouse. Also included in the additional conductor pipe segment at this point is a detonator control assembly shown at 72 which is connected via the wires 64 to the detonator for the explosive charge 63 in the capped end of cemented conductor segment 61. This portion of the installation will be removed following the blowing open of the top end or head of conductor pipe segment 61 as described hereafter. Below the detonator control assembly 72 a fairly strong screen shown at 74 is inserted in the pipe segment 70 by means of coupler 73 so that it can catch blasting wires 64, the venting tube 65 and other any assorted rubble that may result from the blast of the detonator charge 63 which places the oil well into production. Similar to the detonator control assembly 72 the screen 74 and any assorted rubble caught in the screen is removed after the capped end of conductor pipe segment 61 has been blasted open by closing down the stop valve 71 and unscrewing the coupler segments 73. In its place a sand screen also indicated at 74 is inserted for use in screening sand out of any oil and gas production flow through the well during operation.

Figure 8:
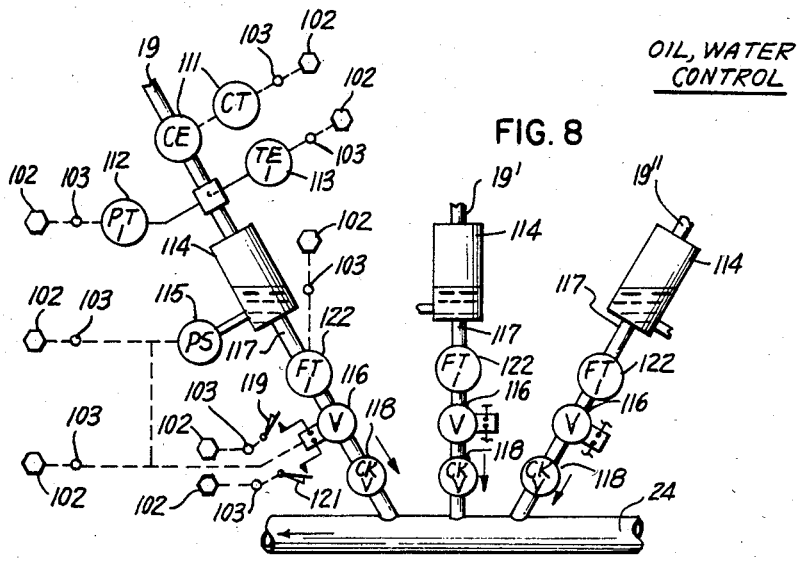
FIG. 8 is a detailed, schematic side sectional view of sub-groups of underground drainage-type mine oil wells constructed according to the invention and filled with necessary sensors and equipment to allow completely automated control over oil production from the wells.

Below the sand screen 74 is a unit 75 which may constitute a coupling for coupling to the production conductor pipe segment 70 an input branch pipeline 77 for supplying to the production conductor pipe 70 and 61 input secondary treatment agents such as high pressure steam, pressurized gas, water, or other suitable treatment agents for increasing flow and production through either the well in question or for increasing production at adjacent well sites in the field. A suitable pressure gauge 76 is attached at the input coupling 75 in order to assure that the input secondary treatment pressure is within presecribed values. If desired, additional metering instruments for temperature, flow rate, etc., can be used as shown in FIG. 8 and for use in monitoring the input of the secondary treatment agents can be installed at this point or the sensors for such parameters can be installed here for leading back to a central control room whereby a master controller can be employed to control these parameters for all the well sites where it is desired to introduce such secondary treatment agents. During normal production from the oil well site, however, the coupling 75 would constitute a straight-through coupling for oil so that it passes down through the lower end of the pipe segment 70 through a second stop valve 78 and any other desired measuring instrument sensor heads indicated generally at 79 for sensing such parameters as the oil and gas pressure, temperature, flow rate, viscosity, or other desired characteristics to be employed in controlling production from the well site. Finally, the conductor pipe segment 70 is coupled to and supplies the collector trunk pipeline 24 for leading the produced oil or gas back out through the tunnel system to the pump 25 at the base of the access shaft 11 for pumping back up to the surface as shown in FIG. 1 of the drawings.

With the conductor pipe segment 61 cemented in place and capped at the top, there is no leakage of fluids through the conductor pipe segment 61 until its upper capped end is blasted open. After the conductor pipe segment 70 is in place together with its appended upper stop valve 71, the detonator blast control unit 72, screen 74, coupler 75, the lower stop and flow control valve 78 and appended instrument sensors 79, the lower stop valve 78 is closed and coupler 75 placed in the position such that the supply input branch line 77 is closed and upper stop valve 71 is maintained open. The detonator wires 64 are then connected to a suitable detonating signal generator for detonating the small explosive charge 63 attached to the capped upper end of the cemented conductor pipe segment 61 as shown in FIG. 6. Upon detonating this charge, the wires 64, venting tube 65 together with other assorted rubble will fall down through the conductor pipe segment and be retained by screen 74. The stop valve 71 then is immediately closed to minimize any flow of gas or oil or other fluids through the conductor pipe and allows the lower portion of pipe segment 70 to be opened up, the screen 74 removed together with the collected rubble and a sand screen inserted in its place and the blasting control assembly 72 removed entirely.

While a wired system for detonating the charge 63 and upper capped end of the conductor pipe 61 has been indicated, it should be appreciated by one of ordinary skill in the art that a ratio controlled detonator could be employed in place of the wired detonator described with relation to FIG. 5. With such an arrangement, the control assembly 72 would comprise an input transmitter end for a microwave signal generator for emitting a microwave signal up through the cemented conductor pipe 61 which would serve as a suitable waveguide to transmit the control microwave signal to the radio wave controlled detonator thereby eliminating the wires 64 from the rubble that will be collected by the screen 74. Collector screen 74 still would be required however for any rubble that might initially drop down through conductor pipe 61 after blasting open the upper capped end of the pipe. A similar radio wave control venting valve could be installed at the capped end of conductor pipe 61 whereby the valve could be opened during cementing and eliminate the need for the fluid impervious venting pipeline 65 together with its exhaust system, but in such eventuality, the end of the production conductor pipe 61 during cementing would have to be connected to a suitable exhaust conduit temporarily provided during the cementing process for exhausting out any vented gas from the mine workings atmosphere. Further, in place of a combined flow control and stop valve 78, it may be desireable to use single valves for each of these purposes wherein in place of a combined valve there would be a separate lower stop valve such as shown at 78 and below that a flow control valve which could be either manually or automatically controlled from a remote located control room. The operating parameter sensor units 79 would then of course have suitable leads out to the master control room to allow an operator of the well to monitor oil and gas flow out of each well site from the master control room location. Such remotely controlled instrumentation and flow control valves as well as the stop and flow control valves including the upper master stop valve 71 could be designed for remote operation and tied in with a suitable computer system to allow computer control of the oil and gas production from all of the well sites as described hereinafter with relation to FIG. 10 in U.S. Pat. No. 4,458,945. Other variations and changes will occur to those skilled in the art of oil well production control for use in place of or in conjunction with the instrumentation and control valve system described above without departing from the spirit of the invention.

In addition to the above-described characteristics, the flow coupler/diverter 75 similarly could be designed to be automatically operated from a remote master control location together with the lower stop valve 78 whereby the production conductor pipe segment 61 of any individual well could be isolated and that well site coupled through the branch pipeline 77 to a supply line 28 for secondary treatment agents extending through the network of horizontal tunnels 16 as shown in FIG. 7A of the drawings. In this manner any individual well site can be either manually or automatically controlled from a remote master control location to convert from a producing well to a well which can be used for injecting secondary treatment agents into the oil bearing sand strata 14 or into an upper gas cap region 17 or a water containing region.

Figure 7B:
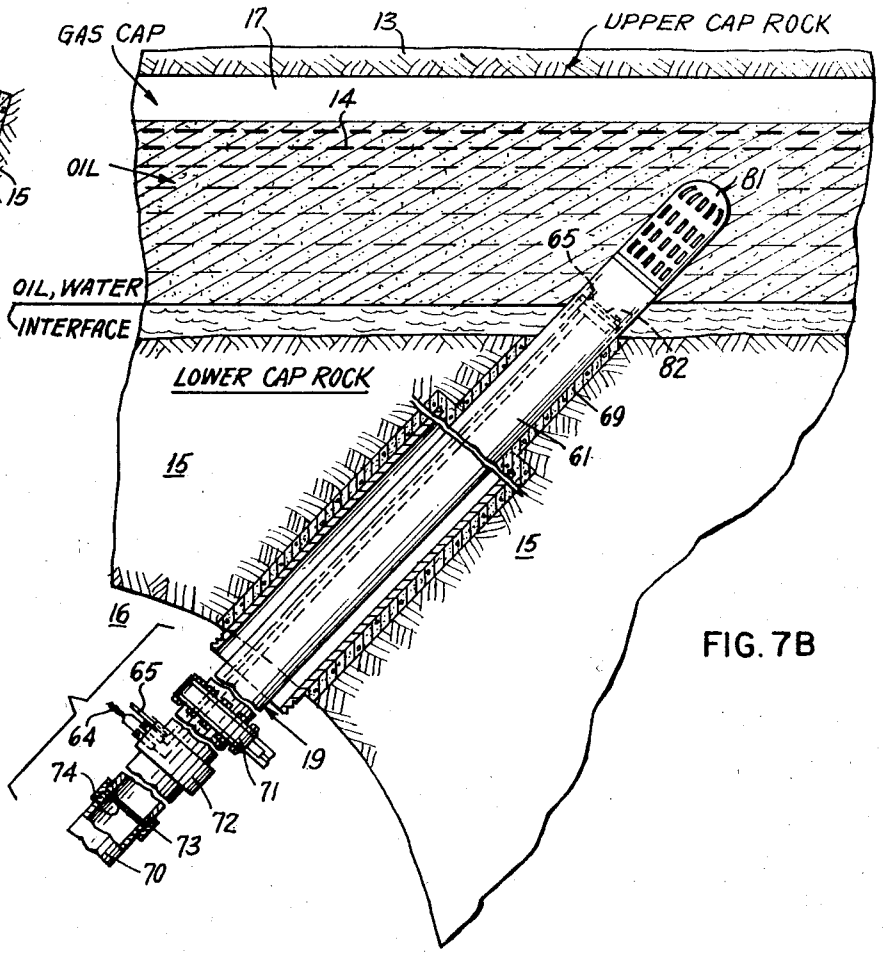
FIG. 7B is a schematic, elongated sectional view of a somewhat different form of drainage-type oil well emplaced in a mine according to the invention which uses a Johnson Screen and also incidentally shows a geological installation where there is a gas cap over an oil bearing sand strata which in turn has an oil/water interface below the oil bearing sand.
Figure 7A:
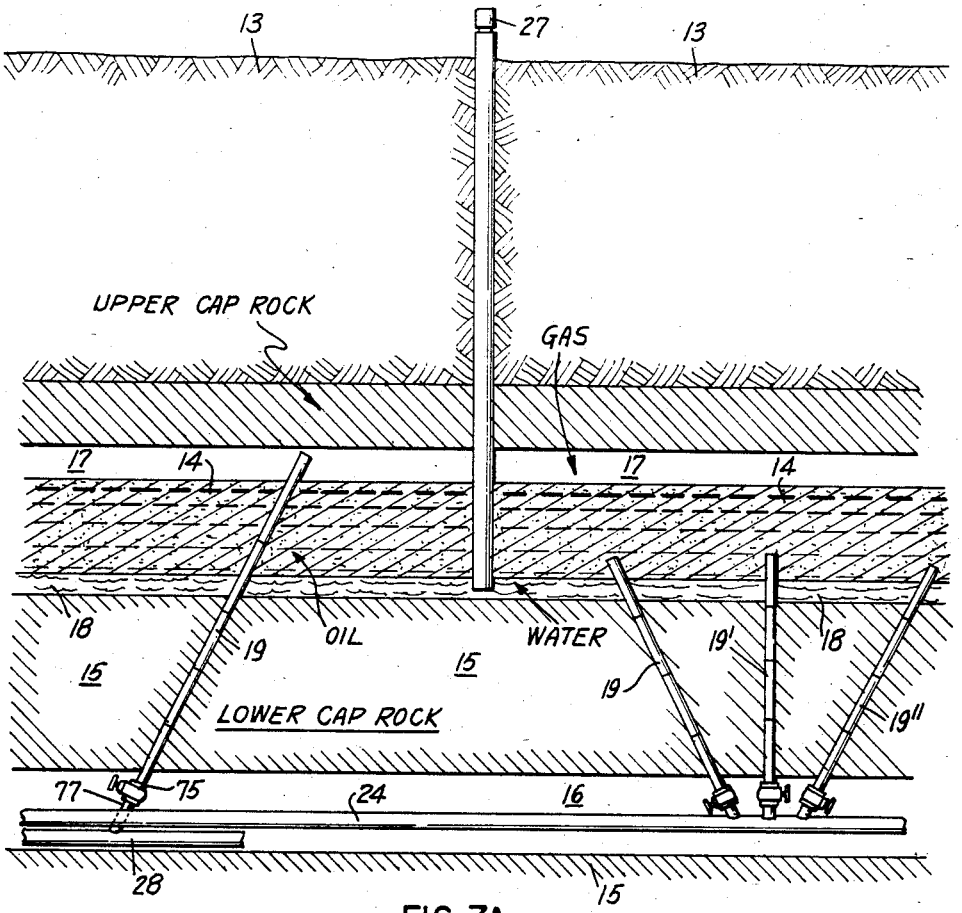
FIG. 7A illustrates a modification of the installation shown in FIG. 1 wherein certain of the relatively small diameter drainage-type oil well production conductor pipes are connected to a supply line for supplying secondary treatment fluids such as steam, compressed air, water or other fluid for pressurizing particular points along the length of a tunnel to improve collection at different points within the tunnel or within the depth of the field having another tunnel or tunnels beyond the pressurization points in the same plane.

Should alternate systems and techniques for opening the capped end of the production conductor pipe 61 to production be desired, FIG. 7B of the drawings illustrates one possible alternate system. In the arrangement of FIG. 7B, a Johnson type screen is shown at 81 secured to the upper top end of the oil conductor pipe segment 61. Below the Johnson type screen 81 is inserted a suitable flap valve 82 which will prevent any back pressurizing of the conductor pipe 61 until it is desired to place the oil well into production. Here again, a small explosive charge will have to be provided to remove the flap valve 82 together with its remotely actuated detonator charge. Similarly, a small vent opening should be provided through the inclusion of a fluid impervious vent tube together with associated stop valve as described with relation to FIG. 5 to facilitate cementing. The detonator for detonating the flap valve 82 and its attendant connected wires and vent tube may be either a wired detonator or radio wave controlled detonator as described above. If the cost is not prohibitive, the flap valve 82 could be designed to permit a slide opening for a sufficient distance to allow venting of the space to be cemented, during the cementing process, to the interior of the production conductor pipe 61. In this eventuality, some suitable conduit system for exhausting the conductor pipe must be provided to prevent any vent gases from escaping into the mine workings atmosphere. In other respects, the installation and procedure for placing the gravity-type oil drain well into production would be entirely similar to that described earlier with respect to FIGS. 5 and 6. Particular care should be taken, however, during the cementing process to assure that cement does not rise to and clog the openings of the Johnson type screen 81.

An alternative arrangement using a Schlumberger type perforating gun to perforate the upper capped opening of the oil production conductor pipe 61 is illustrated in FIG. 9 of the drawings. The Schlumberger type perforating guns are shown at 85. In utilizing this system a closed conductor pipe, as indicated in FIG. 5 would be cemented into the drill hole. The explosive charge 63 and detonation wires 64 would not be needed nor would the blasting control assembly, item 72 of FIGS. 6 and 7B.

After the conductor pipe 61 is cemented in place and the collar end finished to its final form, the stop valve 71 can be attached and the fluid and control assembly 40 can be reattached. The conventional Schlumberger perforation gun could then be modified into segments to permit raising through this unit. The Schlumberger unit would have to be redesigned so that the firing circuitry could be plugged through successive pipe segments that would be needed to raise the perforation gun into firing position.

After the conductor pipe had been perforated as desired, the gun could then be lowered through stop valve 71. Then the fluid control assembly 40 could be removed. The blowout preventors 43 and 44 would prevent fluid and gas leakage into the atmosphere during perforating gun withdrawal. Any fluids produced at this stage would be drained off through valves 45 and 47 as indicated in FIG. 5.

The drainage type oil wells drilled in the above-described manner may be drilled at whatever angle or direction is deemed most feasible for maximization of oil production from a given oil field. The mine workings for access should be designed for each individual oil field but should provide adequate room for collector piping systems, secondary treatment agent piping systems, automated well control systems, ventilation, drainage of the mine workings, and easy access to all well sites for routine inspection and maintenance. During drilling special measures to supply ventilation air and to withdraw any leakage gases around the drilling site by a suitable air and gas exhaust system should be undertaken. This may include jacketing and exhausing the drilling rig. Each oil well site should have its own flow meter to measure production of gas, oil and water, pressure gauge, temperature gauge and any other oil well operating characteristic measurement device needed to provide the required measurement to report continuously to a central control station conditions at each well site within the field being mined. As noted earlier, all well sites can be constructed for either automatic or manual changes in well management or production, or both, depending upon the economics of any given oil field being mined.

Having described several forms of apparatus to be employed in carrying out the novel method of underground mining of petroleum according to, it is believed that other modifications, changes and variations to the described apparatus will occur to those skilled in the art in the light of the above teachings. It is therefore to be understood that may be made to the particular embodiments of the ivention disclosed which are obvious changes to those of ordinary skill in the art and which are believed to come within the scope of the invention as defined by the appended claims.

What is claimed is:

1. A fluid and cuttings control assembly for gravity-type drain oil wells used in oil well mining comprising a stop valve mounted on a drainage oil well pipe casement for securement to a firmly anchored collar pipe providing the outer linear for an access opening to a gravity-type drainage oil well, said stop valve and pipe casement having an inside diameter opening with said stop valve in the open condition sufficient to accommodate the outside diameter of a gravity-type drainage oil well production conductor pipe and drill string-together with appended stop valves, couplings and the like, upper and lower blow-out preventers secured to said casement below said stop valve and having internal diameters while open sufficient to accommodate the external diameter of the gravity-type drainage oil well production conductor pipe and drill string together with fittings, an upper drain vent control valve located in a first drain vent branch pipeline connected to an opening in said casement located between the stop valve and above the upper blow-out preventer for venting the space within said casement between the stop valve and the upper blow-out preventer with the upper blow-out preventer in the closed blow-out preventing condition, and a lower drain vent control valve located in a second drain vent branch pipeline connected to an opening in the casement located intermediate the upper and lower blow-out preventers for venting the space within said casement between said upper and lower blow-out preventers with the upper and lower blow-out preventers in the closed blow-out preventing condition whereby during drilling the first drain vent branch pipeline provides means for removal of drilling fluids, fluids produced, and cuttings to a closed pipeline removal system, the second drain vent branch pipeline provides means for removal of any fluids or cuttings that may pass through the upper blow-out preventer, and during insertion of the production conductor pipe, preparatory to cementing, the first and second drain vent branch pipelines function for removal of any fluids that have been produced from the overlying reservoir: and wherein the lower drain vent control valve connection to the casement is located above the lower blow-out preventer and immediately adjacent thereto and a third drain vent control valve is provided in a third drain vent branch pipeline connected to an opening in the common casement between the upper and lower blow-out preventers and located at a point immediately below and adjacent to the upper blow-out preventer for selectively venting the space in said casement between said upper and lower blow-out preventers while it is being filled with a fluid supplied through said lower drain vent control valve whereby during cementing of a production conductor pipe in place, fluid under pressure completely fills the space between the two blow-out preventers to prevent leakage of cement into this space during the cementing.

2. A fluid and cuttings control assembly according to claim 1 wherein the assembly is designed to support therein a gravity-type drain oil well production oil conductor pipe assembly having a closed upper end together with fluid impervious vent tube means having controllable stop valve means therein for controllably venting the space between the drainage oil well pipe casement and the production oil conductor pipe assembly at the upper distal end thereof, whereby cementing of the production conductor pipe into position is accomplished by introducing cement, under pressure, through the upper drain vent so that the cement will be forced up to completely fill the space between the collar pipe and the production conductor pipe and, above the end of the collar pipe, to completely fill the space between the hole walls and the conductor pipe while the fluid impervious vent tube permits removal of fluids displaced by the cement and recovery of cement slurry through this tube and signals when cementing is completed to the distal upper end of the production conductor pipe and remote control means for selectively producing production oil flow openings in the closed upper distal end of the production conductor pipe after installation for initiating operation of a gravity type drain oil well.

3. A gravity-type drain oil well production oil conductor pipe assembly having a closed upper end together with fluid impervious vent tube means having controllable stop valve means therein for controllably venting space above the closed upper end of the conductor pipe assembly, and remote control means for selectively producing liquid passageway openings in the closed upper end of the conductor pipe assembly after installation, said conductor pipe assembly being proportionally shaped and designed to be inserted in a gravity drainage-type oil well opening formed in the roof or wall of an oil well mine facility by means of a fluid and cuttings control assembly.

4. A gravity-type drain oil well production oil conductor pipe assembly according to claim 3 wherein the production oil conductor pipe further includes in axial alignment an upper stop valve means at its lower end, protective solids collecting oil-pervious screen means disposed in the production pipe below the upper stop valve means, and lower flow control and stop valve means disposed in the production pipe below the upper stop valve means and a production oil discharge outlet end, and wherein the screen permits removal of rock, cement, steel, and other solid fragments produced by the well-completion operation performed by the remote control means for producing production oil flow openings in the upper distal end of the production conductor pipe in order to initiate operation of the gravity-type oil well.

5. A gravity-type drain oil well production oil conductor pipe assembly according to claim 4 further including flow coupler/diverter means disposed in the pipe intermediate the upper and lower stop valve means for diverting a part of the production oil flow for measurement purposes and/or injecting fluids into the oil conductor pipe assembly to enhance oil production.

* * * * *